United States Patent [19]

Panveno

[11] 4,339,034

[45] Jul. 13, 1982

[54] DISC JACKET WARP FREE INSERT

[75] Inventor: Mike Panveno, Canoga Park, Calif.

[73] Assignee: Album Graphics, Inc., Hollywood, Calif.

[21] Appl. No.: 289,762

[22] Filed: Aug. 3, 1981

[51] Int. Cl.[3] ..... B65D 85/30; B65D 85/57

[52] U.S. Cl. ..... 206/313; 220/410

[58] Field of Search ..... 206/313, 309, 310, 311, 206/312; 229/68 R; 211/40; 312/10, 12; 294/6, 27 R; 220/410

[56] References Cited

U.S. PATENT DOCUMENTS 3,376,872 4/1968 Durham ..... 206/313

4,042,106 8/1977 Smith ..... 206/313

*Primary Examiner*—Joseph Man-Fu Moy

*Attorney, Agent, or Firm*—Richard H. Zaitlen

[57] ABSTRACT

An improved disc protector assembly which enables a disc to be protectively held in a manner so as to retard warpage is disclosed. The disc protector assembly of the present invention comprises a jacket having a plurality of flaps forming elongated ridges along the length thereof. A removable disc protector is inserted in the jacket and holds the disc. The protector comprises a first member disposed between the flaps adjacent the ridges, and a second member having outwardly extending arms. The second member urges the disc into contact with the flaps along the length thereof. By the use of the protector assembly, problems associated with warpage are substantially overcome.

7 Claims, 4 Drawing Figures

DISC JACKET WARP FREE INSERT

BACKGROUND OF THE INVENTION

This invention relates to disc protectors for use in the record and video disc industry.

Prior Art

The explosion of the record industry is well documented. Tens of millions of records are sold each year to a variety of consumers desiring different types of music, such as classical, jazz, folk, rock, country rock, and the like. Because of the demand by many consumers for accurate recordings, and further in view of the more advanced turntables and receivers, many record companies are now producing records which, if properly maintained and played, produce incredibly accurate audio signals. These records may cost $10 or even $20 per record. Because the demand for such records is increasing, many record stores order such records in large quantities. Packing such records has become a problem in that care must be taken to insure that warpage does not occur. Warpage of expensive records can cause disgruntled consumers, returns and the like, thereby leading to a loss of goodwill associated with a particular record manufacturer or even recording artist. Thus, there has existed a long-felt need for a method of packing a record so as to prevent such warpage from occurring.

A number of prior art methods are evolved. These prior art methods, however, some of which may be effective, have tended to be expensive. Others are cumbersome, and difficult to use which discourages the consumer from maintaining the record in an environment which retards warpage. Storage of the records by the consumer can thus still lead to warpage. Some packages are only used when shipping the records from the manufacturer to the distributor or seller. Thus, the problem of record warpage still exists.

Another field of incredible growth is the video disc industry. This industry utilizes a disc which employs either a needle, such as for a record player, or a beam of light such as from a laser or the like. Again, the need to insure that such discs do not become warped during transportation or storage has been recognized. However, the solution has proved elusive in terms of being relatively inexpensive and straightforward.

The present invention is directed toward a disc protector assembly which provides a simple, yet effective solution to the aforementioned problems, but in a straightforward and relatively inexpensive manner.

SUMMARY OF THE INVENTION

The present invention is directed to a disc protector assembly which uses an outer jacket presently used throughout the record and video disc industry. Such disc jackets are usually made of cardboard or similar material and are configured such that there is a first and second internal flap along each side of the jacket. Typically, into this outer jacket a disc is placed. In most situations, the disc is first placed in an inner dust cover. The disc protector of the present invention is placed over the inner cover, if such is used, so as to sandwich the disc therebetween. The disc protector is comprised of first and second generally rectangular members. The first member has a width slightly less than the distance between the flaps and is placed therebetween. The second member has outwardly extending sections or arms such that the overall width is slightly less than the width of the jacket. The arms of the second member urges the disc against the flaps.

In a typical situation, the inner cover containing the disc, and the disc protector are slid into the jacket such that the outwardly extending arms of the disc protector are disposed beneath and adjacent to the flaps on the outer jackets. In this manner, the edges of the disc are sandwiched between the flaps along one side and the arms along the other. This tends to equalize the forces on the edges of the disc thereby retarding warpage due to unequal forces.

The novel features which are believed to be characteristic of the invention, both as to its organization and method of operation, together with further objectives and advantages thereof, will be better understood from the following description considered in connection with the accompanying drawings in which the presently preferred embodiment of the invention is illustrated by way of example. It is to be expressly understood, however that the drawing is for the purpose of illustration and description only, and is not intended as a definition of the limits of the invention.

DESCRIPTION OF THE PREFERRED EMBODIMENT

Figure 1:
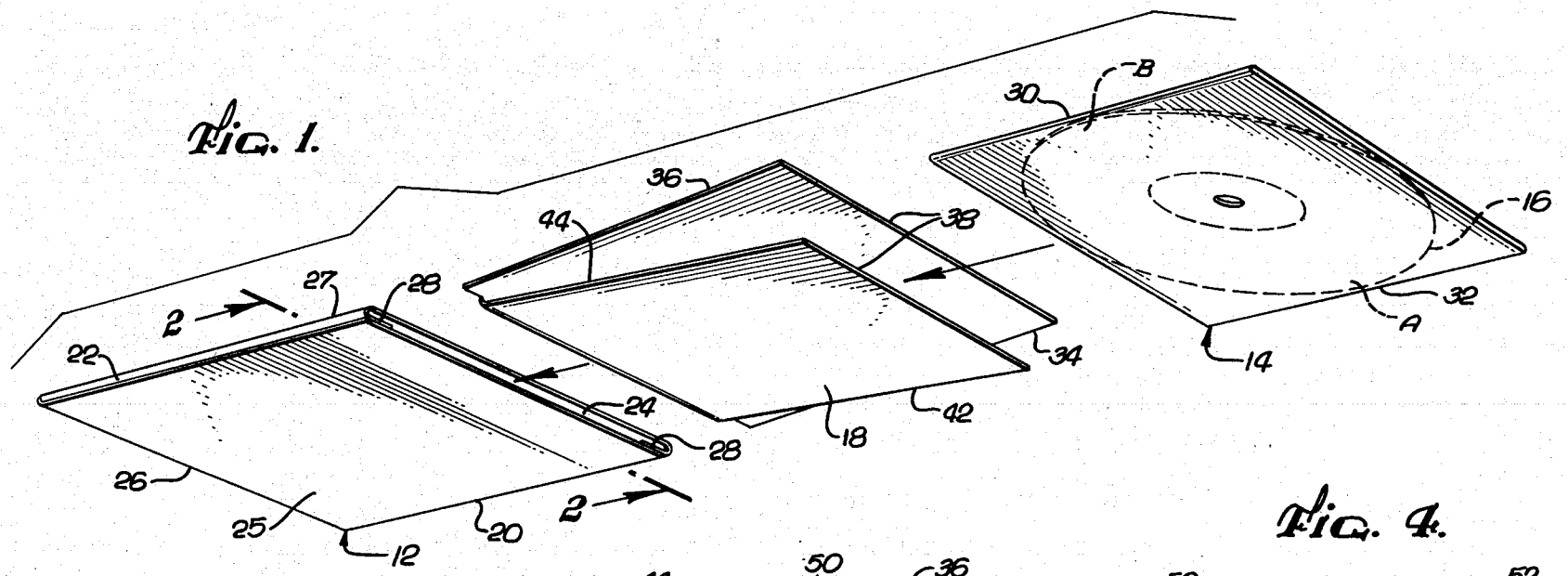
FIG. 1 is an exploded perspective view showing the disc protector assembly of the present invention.
Figure 2:
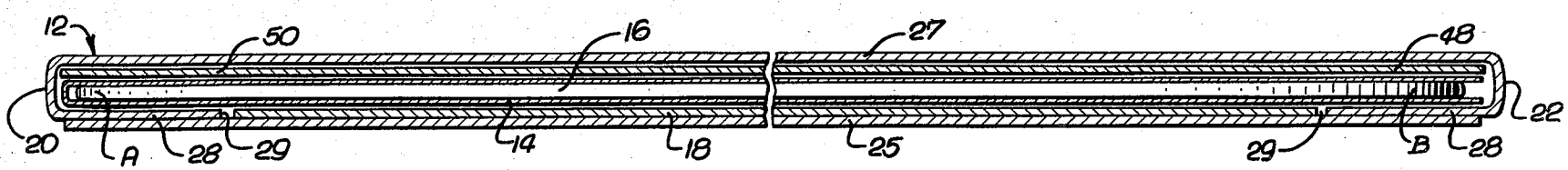
FIG. 2 is a cut-away view of FIG. 1 taken along lines 2—2 and showing how a typical disc is held in place by the assembly of the present invention.

Referring first to FIGS. 1 and 2, the overall assembly of the present invention is illustrated. The assembly 10 is comprised of a first outer jacket or cover 12, a second inner cover 14, which contains a disc 16, and the disc protector 18. As used in this application, the term "disc" is meant to cover both circular records and videodiscs, as well as discs which could be used by computers and the like.

Referring specifically now to the generally rectangular outer jacket 12, one can see that it is comprised of first and second sides 20, 22, a first open end 24, into which the record or disc is inserted, and a second closed end 26. Sides 20 and 24 are folded beneath top 25 and joined thereto, usually with glue, to form coplanar flaps 28. Flaps 28 create ridges 29 which extend along the length of outer jacket 12. Jacket 12 is well known and used in the record and video disc industry and is usually made of a cardboard material approximately 0.022 inch thick. Advertising and other similar art work can be printed on top 25 as well as bottom 27. Other similar jackets such as those only having one or more than two internally formed flaps are also within the scope of this invention.

The generally rectangular inner cover 14 is also comprised of first and second sides 30, 32, and has an open end into which the disc 16 is inserted. The length and width of cover 14 are selected such that it can be slid into outer jacket 12 with a small clearance. Such inner covers 14 are well known in the art and are usually referred to as "dust covers". They are typically made of a relatively thin piece of paper and may also contain printing on the top and bottom thereof.

Figure 3:
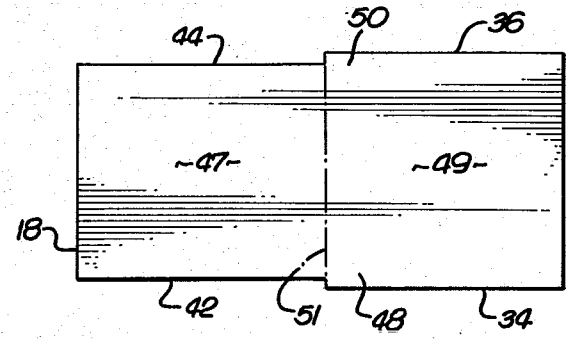
FIG. 3 is a top plan view showing a first embodiment of the disc protector of the present invention.

The generally rectangular disc protector 18 also has first and second sides 34, 36, and first and second ends 38, 40, and is comprised of a top member 45 and a bottom member 47. One can see that the sides of the bottom member 47, sides 34, 36, extend beyond the sides 42, 44 of the top member 45. These extensions are referred to herein as arms 48, 50 as shown in FIG. 3. The top and bottom members 45, 47 are preferably made of one piece of material and are folded along fold line 51 such that they are of equal length. Top and bottom members 45, 47 are preferably made of one piece of material and are joined along common end 40.

Referring now to FIGS. 1 and 2, one can see that the record 16 is held in the inner cover 14 which is placed within the disc protector 18. More specifically, top and bottom members 45 and 47 sandwich the disc 16 therbetween and otherwise hold it in place within the outer jacket 12.

It has been discovered that without the disc protector 18, the edges of the record, generally indicated as edges A and B, would have an unequalized force applied to them because of the flaps 28. This force may not be that great for one record, but if 10, 15 or more records are placed one atop the other, one can more readily appreciate the force that flaps 28 could exert on edges A and B. It has been discovered that such forces can be counterbalanced by the use of the disc protector 18. More specifically, top member 45 is disposed between and adjacent to the flaps 28 and the ridges 29 which they form. Member 45 thus "fills in" the space between flaps 28. Member 47 is configured such that it, along with member 45, retains the disc 16 in the position and urges edges A and B against flaps 28. While FIG. 1 shows disc protector 18 being inserted into jacket 12 such that open end 38 is adjacent open end 24 of jacket 12, the reverse can also be used. That is, open end 38 could be inserted first such that closed end 40 is adjacent end 24. This has the advantage of further protecting the disc 16 from accidentally falling out of the jacket 12.

Once protector 18 is in place, the pressure applied to the top 25 or bottom 27 of the jacket 12, and thus to record 16, would be substantially more equalized. In this manner the likelihood of warpage at the edges A and B is reduced.

Figure 4:
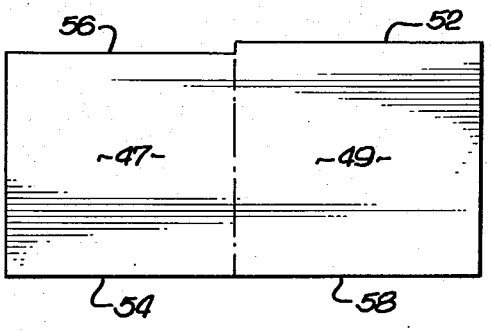
FIG. 4 is another plan view showing a second embodiment of the disc protector of the present invention.

Referring now to FIG. 4, a second embodiment of the disc protector 18 is illustrated. This embodiment is directed to "double albums" in which the outer jacket is formed such that there is one cover which has two flaps such as shown in FIGS. 1 and 2, and a second cover (not shown) which would be for the second disc and which would only contain one flap. Thus, in the second embodiment, the bottom member 49 only has one arm 52. Side 58 is coextensive with side 54 of the top member 47, and thus only side 52 extends beyond and outside of side 56. In the second embodiment, one protector such as shown in FIG. 3 and one protector such as shown in FIG. 4 would be used.

While this invention has been described in its preferred embodiments, it is to be understood that the words which have been used are words of description rather than of limitation, and that changes within the purview of the appended claims may be made without departing from the true spirit and scope of the invention in its broader aspects.

I claim:

1. In a disc jacket having a plurality of flaps forming elongated ridges, the improvement comprising a removable disc protector having first and second members, with said first member disposed between said flaps and adjacent said ridges, and said second member having outwardly extending arms disposed beneath said flaps, said second member for urging said disc into contact with said flaps along the length thereof, whereby a disc is retained between said flaps and said protector so as to equalize the forces on the edges of said disc.

2. A disc jacket according to claim 1 wherein said first and second members each have a generally rectangular configuration.

3. A disc jacket according to claim 1 wherein said disc protector is comprised of first and second generally rectangular members joined along a first common end, and said second member including arms which extend beyond first and second sides of said first member.

4. A disc jacket according to claim 1 wherein said disc jacket defines first and second outer covers, each said cover having flap members upon which said disc is to be disposed and wherein one disc protector is disposed in each said cover.

5. A disc jacket according to claim 1 wherein a disc is sandwiched between said arm members and said flaps.

6. A disc jacket and removable disc protector assembly for protecting a disc, comprising:

(a) a generally rectangular disc jacket having first and second opposing sides and first and second opposing ends, a top and a bottom, said first end along with said top and bottom defining an opening through which said disc protector is placed, and wherein said sides of said jacket are joined to and terminate beneath said top forming first and second elongated flaps; and a generally rectangular disc protector having first and second members joined along a common end and wherein the sides of said second member extend beyond the sides of said first member, said first member having a width slightly less than the distance between said flaps and disposed adjacent to and between said flaps, and said second member having a width slightly less than the distance between said first and second sides and disposed beneath said flaps, said second member for urging said disc into contact with said flaps so as to equalize the forces on the edges of the disc.

7. A disc jacket according to claim 6 wherein said disc is a circular record having a diameter slightly less than the distance between said first and second sides.

* * * * *